US009181941B2

(12) United States Patent
Cirou et al.

(10) Patent No.: US 9,181,941 B2
(45) **Date of Patent: *Nov. 10, 2015**

(54) CIRCUIT FOR BIOLOGICAL LIQUID

(71) Applicant: EMD Millipore Corporation, Billerica, MA (US)

(72) Inventors: Sebastien Cirou, Schiltigheim (FR); Jean-Louis Weissenbach, Ville (FR)

(73) Assignee: EMD Millipore Corporation, Billerica, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/080,826

(22) Filed: Nov. 15, 2013

(65) Prior Publication Data

US 2014/0069537 A1 Mar. 13, 2014

Related U.S. Application Data

(62) Division of application No. 13/004,425, filed on Jan. 11, 2011, now Pat. No. 9,051,929.

(30) Foreign Application Priority Data

Jan. 13, 2010 (FR) ..... 10 50209

(51) Int. Cl.
*F04B 43/02* (2006.01)
*F04B 43/14* (2006.01)
(Continued)

(52) U.S. Cl.
CPC ..... *F04B 43/14* (2013.01); *B01L 3/502738* (2013.01); *F04B 43/043* (2013.01); *B01L 3/502753* (2013.01); *B01L 2400/0655* (2013.01); *Y10T 137/85978* (2015.04)

(58) Field of Classification Search
CPC ..... F04B 43/02; F04B 43/023; F04B 43/025; F04B 43/028; A61M 1/16; A61M 1/28
USPC ..... 417/474, 478, 479; 604/29, 33, 410; 251/61, 61.1; 137/565.01, 565.11, 137/565.13, 561 R, 597, 884; 210/29, 33, 210/410
See application file for complete search history.

(56) References Cited

U.S. PATENT DOCUMENTS 2,413,853 A 1/1947 Zademach et al.
2,787,403 A 4/1957 Carr et al.
(Continued)

FOREIGN PATENT DOCUMENTS

CN 101281204 A 10/2008
DE 10 2006 059 459 A1 7/2008
(Continued)

OTHER PUBLICATIONS

Notice of Allowance mailed Apr. 14, 2014 in co-pending U.S. Appl. No. 13/116,508.
(Continued)

*Primary Examiner* — Devon Kramer
*Assistant Examiner* — Patrick Hamo
(74) *Attorney, Agent, or Firm* — Nields, Lemack & Frame, LLC

(57) ABSTRACT

The invention concerns a circuit comprising a bag (111) comprising two flexible films (145, 146) and routing network connectors, and a press (110) comprising a first shell (114) and a second shell (113) clamping the bag to form pipes (104) between the films, the first shell comprising a pinch valve (120) which comprises an actuator (121) comprising a movable member (124) and in register with the moveable member an elastically compressible pad (131) which, when the valve is in an open position, has a resting configuration in which a second face (33) of the pad is concave and locally delimits a shaping channel (118), and, when the valve is in a closed position, has a pinching configuration in which the second face (133) is convex, with the pipe and the pad sandwiched between a shaping channel (116) and the moveable member.

12 Claims, 6 Drawing Sheets

(51) Int. Cl.
*F04B 43/04* (2006.01)
*B01L 3/00* (2006.01)

(56) References Cited

U.S. PATENT DOCUMENTS

| | | | |
|---|---|---|---|
| 2,941,575 | A | 6/1960 | Malmberg et al. |
| 3,022,229 | A | 2/1962 | Heden |
| 3,179,117 | A | 4/1965 | Gibson et al. |
| 3,667,487 | A | 6/1972 | Schoenbeck et al. |
| 3,772,154 | A | 11/1973 | Isenberg et al. |
| 3,774,762 | A | 11/1973 | Lichtenstein |
| 4,113,623 | A | 9/1978 | Koether et al. |
| 4,332,750 | A | 6/1982 | Roggenburg, Jr. et al. |
| 4,370,983 | A | 2/1983 | Lichtenstein |
| 4,784,751 | A | 11/1988 | McGehee |
| 4,790,118 | A | 12/1988 | Chilcoate |
| 4,852,851 | A | 8/1989 | Webster |
| 4,855,236 | A | 8/1989 | Levin |
| 4,915,119 | A | 4/1990 | Franklin |
| 5,019,257 | A | 5/1991 | Suzuki et al. |
| 5,141,866 | A | 8/1992 | Levin |
| 5,265,912 | A | 11/1993 | Natividad |
| 5,290,518 | A | 3/1994 | Johnson |
| 5,342,463 | A | 8/1994 | Addeo et al. |
| 5,520,885 | A | 5/1996 | Coelho et al. |
| 5,628,908 | A | 5/1997 | Kamen et al. |
| 5,645,723 | A | 7/1997 | Fujishiro et al. |
| 5,678,568 | A | 10/1997 | Uchikubo et al. |
| 5,711,916 | A | 1/1998 | Riggs et al. |
| 5,738,645 | A | 4/1998 | Plotkin |
| 5,985,653 | A | 11/1999 | Armstrong et al. |
| 6,073,942 | A | 6/2000 | Heneveld, Sr. |
| 6,099,734 | A | 8/2000 | Boggs et al. |
| 6,129,099 | A | 10/2000 | Foster et al. |
| 6,146,124 | A | 11/2000 | Coelho et al. |
| 6,186,998 | B1 | 2/2001 | Inuzuka et al. |
| 6,213,334 | B1 | 4/2001 | Coelho et al. |
| 6,228,255 | B1 | 5/2001 | Peterson et al. |
| 6,232,115 | B1 | 5/2001 | Coelho et al. |
| 6,303,025 | B1 | 10/2001 | Houchens |
| 6,361,642 | B1 | 3/2002 | Bellamy et al. |
| 6,670,169 | B1 | 12/2003 | Schob et al. |
| 6,808,675 | B1 | 10/2004 | Coelho et al. |
| 6,902,706 | B1 | 6/2005 | Colin et al. |
| 6,982,063 | B2 | 1/2006 | Hamel et al. |
| 7,153,286 | B2 * | 12/2006 | Busby et al. ..... 604/6.11 |
| 7,326,355 | B2 | 2/2008 | Graetz et al. |
| 7,485,224 | B2 | 2/2009 | Jones et al. |
| 7,648,627 | B2 | 1/2010 | Beden et al. |
| 7,666,602 | B2 | 2/2010 | Ammann et al. |
| 7,867,189 | B2 * | 1/2011 | Childers et al. ..... 604/29 |
| 7,935,074 | B2 | 5/2011 | Plahey et al. |
| 7,935,253 | B2 | 5/2011 | Beulay et al. |
| 8,114,276 | B2 | 2/2012 | Childers et al. |
| 8,163,172 | B2 | 4/2012 | Beulay et al. |
| 8,343,356 | B2 | 1/2013 | Beulay et al. |
| 8,383,397 | B2 | 2/2013 | Wojciechowski et al. |
| 8,505,959 | B2 | 8/2013 | Darling, III |
| 8,506,798 | B2 | 8/2013 | Beulay et al. |
| 8,557,113 | B2 | 10/2013 | Beulay et al. |
| 8,900,454 | B2 | 12/2014 | Cirou et al. |
| 8,906,229 | B2 | 12/2014 | Cirou et al. |
| 8,916,045 | B2 | 12/2014 | Reinbigler et al. |
| 8,921,096 | B2 | 12/2014 | Weissenbach et al. |
| 9,051,929 | B2 | 6/2015 | Cirou et al. |
| 2003/0040104 | A1 | 2/2003 | Barbera-Guillem |
| 2004/0031507 | A1 | 2/2004 | Ross et al. |
| 2004/0104153 | A1 | 6/2004 | Yang |
| 2004/0222341 | A1 | 11/2004 | Breda et al. |
| 2004/0259240 | A1 | 12/2004 | Fadden |
| 2005/0254879 | A1 | 11/2005 | Gundersen et al. |
| 2006/0024212 | A1 | 2/2006 | Hwang |
| 2006/0057030 | A1 | 3/2006 | Lee et al. |
| 2006/0118472 | A1 | 6/2006 | Schick et al. |
| 2006/0226333 | A1 | 10/2006 | Newkirk |
| 2007/0095364 | A1 | 5/2007 | Watt |
| 2007/0112297 | A1 | 5/2007 | Plahey et al. |
| 2007/0128087 | A1 | 6/2007 | Cannizzaro et al. |
| 2007/0199875 | A1 | 8/2007 | Moorey et al. |
| 2007/0278155 | A1 | 12/2007 | Lo et al. |
| 2008/0023045 | A1 | 1/2008 | Miller et al. |
| 2008/0057274 | A1 | 3/2008 | Hagiwara et al. |
| 2008/0213143 | A1 | 9/2008 | Gyonouchi et al. |
| 2008/0254962 | A1 | 10/2008 | Mizuo et al. |
| 2009/0050756 | A1 | 2/2009 | Newkirk et al. |
| 2009/0101219 | A1 | 4/2009 | Martini et al. |
| 2009/0101552 | A1 | 4/2009 | Fulkerson et al. |
| 2009/0111179 | A1 | 4/2009 | Hata et al. |
| 2009/0180933 | A1 | 7/2009 | Kauling et al. |
| 2009/0215602 | A1 | 8/2009 | Min et al. |
| 2009/0294349 | A1 | 12/2009 | Beulay et al. |
| 2009/0314970 | A1 | 12/2009 | McAvoy et al. |
| 2010/0108920 | A1 | 5/2010 | Tatarek |
| 2010/0126927 | A1 | 5/2010 | Blankenstein et al. |
| 2010/0187167 | A1 * | 7/2010 | Reinbigler et al. ..... 210/85 |
| 2010/0204765 | A1 | 8/2010 | Hall et al. |
| 2010/0206785 | A1 | 8/2010 | Beulay et al. |
| 2010/0234805 | A1 | 9/2010 | Kaufmann et al. |
| 2011/0174716 | A1 | 7/2011 | Beulay et al. |
| 2011/0297866 | A1 | 12/2011 | Weber |
| 2011/0303306 | A1 | 12/2011 | Weber |
| 2012/0006736 | A1 | 1/2012 | Cirou et al. |
| 2012/0018018 | A1 | 1/2012 | Cirou et al. |
| 2012/0031510 | A1 | 2/2012 | Weissenbach et al. |
| 2012/0138173 | A1 | 6/2012 | Cirou et al. |
| 2012/0138522 | A1 | 6/2012 | Cirou et al. |
| 2012/0145616 | A1 | 6/2012 | Weissenbach et al. |
| 2012/0160342 | A1 | 6/2012 | Weissenbach et al. |
| 2012/0160356 | A1 | 6/2012 | Reinbigler et al. |
| 2012/0168390 | A1 | 7/2012 | Beulay et al. |
| 2012/0248025 | A1 | 10/2012 | Reinbigler et al. |
| 2013/0087490 | A1 | 4/2013 | Beulay et al. |
| 2013/0193073 | A1 | 8/2013 | Hogard et al. |
| 2013/0210130 | A1 | 8/2013 | Larcher et al. |
| 2013/0236130 | A1 | 9/2013 | Cirou et al. |
| 2013/0240065 | A1 | 9/2013 | Weissenbach et al. |
| 2015/0008184 | A1 | 1/2015 | Cirou et al. |
| 2015/0013773 | A1 | 1/2015 | Cirou et al. |

FOREIGN PATENT DOCUMENTS

| | | | |
|---|---|---|---|
| DE | 10 2008 003 823 | A1 | 7/2008 |
| EP | 0479047 | A2 | 4/1992 |
| EP | 0803723 | A1 | 10/1997 |
| EP | 1195171 | A2 | 4/2002 |
| EP | 1239277 | A1 | 9/2002 |
| EP | 2044964 | A2 | 4/2009 |
| EP | 2130903 | A1 | 12/2009 |
| EP | 2208534 | A1 | 7/2010 |
| EP | 2228635 | A1 | 9/2010 |
| FR | 2241615 | A1 | 3/1975 |
| FR | 2673853 | A1 | 9/1992 |
| FR | 2931838 | A1 | 12/2009 |
| FR | 2940145 | A1 | 6/2010 |
| GB | 1434786 | | 5/1976 |
| GB | 2448858 | A | 11/2008 |
| JP | 62-081543 | A | 4/1987 |
| JP | 2010-502405 | A | 1/2010 |
| WO | 00/48703 | A1 | 8/2000 |
| WO | 2005/090403 | A2 | 9/2005 |
| WO | 2006/043895 | A1 | 4/2006 |
| WO | 2007/094254 | A1 | 8/2007 |
| WO | 2008/033788 | A2 | 3/2008 |
| WO | 2008/064242 | A2 | 5/2008 |
| WO | 2008/071351 | A1 | 6/2008 |
| WO | 2008/120021 | A1 | 10/2008 |
| WO | 2009/017614 | A1 | 2/2009 |
| WO | 2009/073567 | A1 | 6/2009 |
| WO | 2009/157852 | A1 | 12/2009 |

(56) References Cited

FOREIGN PATENT DOCUMENTS

| | | | |
|---|---|---|---|
| WO | 2010/084432 | A1 | 7/2010 |
| WO | 2010/094249 | A1 | 8/2010 |

OTHER PUBLICATIONS

Notice of Allowance mailed Apr. 14, 2014 in co-pending U.S. Appl. No. 13/153,809.
Final Rejection mailed Jun. 23, 2014 in co-pending U.S. Appl. No. 12/685,140.
Notice of Allowance mailed Feb. 18, 2014 in co-pending U.S. Appl. No. 13/116,508.
Notice of Allowance mailed Feb. 3, 2014 in co-pending U.S. Appl. No. 13/430,734.
French Search Report dated Feb. 9, 2009 in co-pending foreign patent application No. FR 0853629.
French Search Report dated Oct. 16, 2009 in co-pending French Patent Application No. FR 0950435.
Chinese Communication, with English translation, dated Sep. 27, 2012 in co-pending Chinese patent application No. CN 201010004496.1.
International Search Report and Written Opinion received for PCT application No. PCT/IB2010/050102, mailed on May 7, 2010, 10 pages.
International Preliminary Report on Patentability received for PCT application No. PCT/IB2010/050102, mailed on Aug. 4, 2011, 8 pages.
Extended European Search Report and Search Opinion received for EP Patent Application No. 10290005.7, mailed on May 17, 2010, 5 pages.
French Search Report dated Sep. 24, 2010 in corresponding foreign patent application No. FR 1050209.
French Search Report dated Nov. 25, 2010 in co-pending foreign patent application No. FR 1054514.
French Search Report dated Nov. 12, 2010 in co-pending foreign patent application No. FR 1055025.
French Search Report dated Feb. 3, 2011 in co-pending foreign patent application No. FR 1055026.
French Search Report dated May 24, 2011 in co-pending foreign patent application No. FR 1056421.
Extended European Search Report for co-pending foreign patent application No. EP 09290938.1 (now U.S. Pat. No. 8,557,113), mailed Apr. 6, 2010.
French Search Report dated Nov. 22, 2010 in co-pending foreign patent application No. FR 1054517.
French Search Report dated Nov. 22, 2010 in co-pending foreign patent application No. FR 1054516.
French Search Report dated Nov. 17, 2011 in co-pending foreign patent application No. FR 1152556.
International Search Report mailed Jun. 8, 2011 in corresponding PCT Application No. PCT/IB2011/050089.
Written Opinion of the International Searching Authority mailed Jun. 8, 2011 in corresponding PCT application No. PCT/IB2011/050089.
International Preliminary Report on Patentability mailed Jul. 26, 2012 in corresponding PCT application No. PCT/IB2011/050089.
International Search Report/Written Opinion mailed Sep. 30, 2011 in co-pending PCT Application No. PCT/IB2011/052447.
International Preliminary Report on Patentability mailed Dec. 20, 2012 in co-pending PCT application No. PCT/IB2011/052447.
International Search Report mailed Sep. 29, 2011 in co-pending PCT Application No. PCT/IB2011/052676.
Written Opinion of the International Searching Authority mailed Sep. 29, 2011 in co-pending PCT application No. PCT/IB2011/052676.
International Preliminary Report on Patentability mailed Jan. 10, 2013 in co-pending PCT application No. PCT/IB2011/052676.
International Search Report mailed Aug. 29, 2011 in co-pending PCT Application No. PCT/IB2011/052679.
Written Opinion of the International Searching Authority mailed Aug. 29, 2011 in co-pending PCT application No. PCT/IB2011/052679.
International Preliminary Report on Patentability mailed Jan. 10, 2013 in co-pending PCT application No. PCT/IB2011/052679.
International Search Report mailed Aug. 2, 2011 in co-pending PCT Application No. PCT/IB2011/052448.
Written Opinion of the International Searching Authority mailed Aug. 2, 2011 in co-pending PCT application No. PCT/IB2011/052448.
International Preliminary Report on Patentability mailed Dec. 20, 2012 in co-pending PCT application No. PCT/IB2011/052488.
International Search Report/Written Opinion mailed Sep. 28, 2011 in co-pending PCT Application No. PCT/IB2011/052450.
International Preliminary Report on Patentability mailed Dec. 20, 2012 in co-pending PCT application No. PCT/IB2011/052450.
International Search Report mailed Sep. 4, 2012 in co-pending PCT application No. PCT/IB2012/051424.
Office Action—Restriction—mailed Jan. 27, 2012 in co-pending U.S. Appl. No. 12/685,140.
Office Action mailed Jun. 28, 2012 in co-pending U.S. Appl. No. 12/685,140.
Final Rejection mailed Jan. 24, 2013 in co-pending U.S. Appl. No. 12/685,140.
Office Action mailed Dec. 17, 2013 in co-pending U.S. Appl. No. 12/685,140.
Office Action—Restriction—mailed Oct. 15, 2013 in corresponding U.S. Appl. No. 13/004,425.
Office Action mailed Jan. 16, 2014 in corresponding U.S. Appl. No. 13/004,425.
Office Action mailed Oct. 9, 2013 in co-pending U.S. Appl. No. 13/116,508.
Office Action mailed Oct. 18, 2013 in co-pending U.S. Appl. No. 13/116,508.
Office Action—Restriction—mailed Apr. 25, 2013 in co-pending U.S. Appl. No. 13/161,975.
Notice of Allowance mailed May 13, 2013 in co-pending U.S. Appl. No. 13/161,975.
Notice of Allowance mailed Apr. 1, 2013 in co-pending U.S. Appl. No. 13/161,983.
Office Action mailed Oct. 25, 2013 in co-pending U.S. Appl. No. 13/187,698.
Office Action—Restriction—mailed Apr. 2, 2013 in co-pending U.S. Appl. No. 13/153,804.
Notice of Allowance mailed May 6, 2013 in co-pending U.S. Appl. No. 13/153,804.
Office Action mailed Oct. 23, 2013 in co-pending U.S. Appl. No. 13/153,809.
Notice of Allowance mailed Mar. 18, 2014 in co-pending U.S. Appl. No. 13/116,508.
Final Rejection mailed Mar. 26, 2014 in co-pending U.S. Appl. No. 13/187,698.
Notice of Allowance mailed Apr. 1, 2014 in co-pending U.S. Appl. No. 13/153,809.
Office Action mailed Dec. 11, 2014 in co-pending U.S. Appl. No. 13/414,843.
Office Action mailed Jan. 6, 2015 in co-pending U.S. Appl. No. 12/685,140.
Office Action mailed Aug. 25, 2014 in corresponding U.S. Appl. No. 13/004,425.
Notice of Allowance mailed Aug. 11, 2014 in co-pending U.S. Appl. No. 13/116,508.
Office Action mailed Jul. 24, 2014 in co-pending U.S. Appl. No. 13/187,698.
Notice of Allowance mailed Aug. 8, 2014 in co-pending U.S. Appl. No. 13/153,809.
Notice of Allowance mailed Jul. 2, 2014 in co-pending U.S. Appl. No. 13/430,734.
Notice of Allowance mailed Aug. 12, 2014 in co-pending U.S. Appl. No. 13/430,734.
Korean communication, with English translation, dated Jul. 31, 2014 in co-pending Korean patent application No. 10-2013-7000355.
Korean communication, with English translation, dated Jul. 31, 2014 in co-pending Korean patent application No. KR 10-2013-7001692.

(56) References Cited

OTHER PUBLICATIONS

Korean communication, with English translation, dated Jul. 31, 2014 in co-pending Korean patent application No. KR 10-2013-7000366.
Korean communication, with Enlgish translation, dated Jul. 31, 2014 in co-pending Korean patent application No. KR 10-2013-7000356.
Notice of Allowance mailed Sep. 3, 2014 in co-pending U.S. Appl. No. 13/116,508.
Notice of Allowance mailed Sep. 2, 2014 in co-pending U.S. Appl. No. 13/153,809.
Notice of Allowance mailed Sep. 29, 2014 in co-pending U.S. Appl. No. 13/430,734.
Notice of Allowance mailed Nov. 6, 2014 in co-pending U.S. Appl. No. 13/187,698.
Final Rejection mailed Feb. 5, 2015 in co-pending U.S. Appl. No. 13/414,843.
Notice of Allowance mailed Feb. 2, 2015 in corresponding U.S. Appl. No. 13/004,425.
Notice of Allowance mailed Jul. 2, 2015 in co-pending U.S. Appl. No. 13/161,983.
Notice of Allowance mailed Jul. 2, 2015 in co-pending U.S. Appl. No. 13/153,804.
Notice of Allowance mailed Jul. 20, 2015 in co-pending U.S. Appl. No. 13/161,975.
Final Rejection mailed Aug. 19, 2015 in co-pending U.S. Appl. No. 12/685,140.
Office Action mailed Aug. 7, 2015 in co-pending U.S. Appl. No. 13/414,843.

* cited by examiner

CIRCUIT FOR BIOLOGICAL LIQUID

This application is a divisional of U.S. patent application Ser. No. 13/004,425 filed Jan. 11, 2011, which claims priority of French Patent Application No. filed Jan. 13, 2010, the disclosures of which are incorporated herein by reference.

The invention relates to circuits for biological liquid, in particular, but not exclusively, for purifying a biopharmaceutical liquid in order to obtain a product such as monoclonal antibodies, vaccines or recombinant proteins.

It is known that biopharmaceutical liquids are in general obtained by culture in a bioreactor and that they must then be treated to achieve the required characteristics of purity, concentration, absence of viruses, etc.

These treatments are conventionally carried out in dedicated installations comprising stainless steel pipes and other parts such as tanks or filter housings, which necessitate operations before and after the actual treatment, which are relatively onerous, in particular operations of cleaning after use.

Within the last few years, these treatments have alternatively been carried out in installations in which the components in contact with the liquid are single-use components.

Such single-use components have the advantage of avoiding cleaning operations, but, to provide the required degree of security, the implementation of an installation with such components necessitates operations of selection, assembly and verification which are relatively complex.

This is especially the case when the number of pipes and other circuit components, for example connectors and pinch valves, is high and/or when the operating pressure is high.

The invention aims to provide a circuit having a high quality of obturation of the pinch valves in a simple, economical and convenient manner.

For this, the invention concerns a circuit for biological liquid, comprising a plurality of connectors and a network for routing liquid between said connectors, characterized in that it comprises:

- a bag comprising two flexible films and said routing network connectors; and
- a press comprising a first shell and a second shell clamping said bag in a state in which pipes of said liquid routing network are formed between said films, said first shell comprising for each said pipe a shaping channel, said second shell comprising for each said pipe a shaping channel facing the corresponding shaping channel of the first shell; with
- said first shell comprising at least one pinch valve for a said pipe, which valve comprises an actuator comprising a movable pinching member which valve has an open position in which the moveable member is in a retracted position in which it does not pinch the pipe and has a closed position in which the moveable member is in an extended position in which it pinches the pipe;
- said valve further comprising, in register with said moveable pinching member, an elastically compressible pad, which pad has a first face nearest the moveable member and a second face nearest the pipe to pinch, which pad, when the valve is in an open position, has a resting configuration in which said second face is concave and locally delimits the first shell shaping channel of the pipe to pinch, and, when the valve is in a closed position, has a pinching configuration in which said second face is convex, with said pipe and said pad sandwiched between the second shell shaping channel of the pipe to pinch and the moveable pinching member.

By virtue of its compressibility, the elastically compressible pad according to the invention makes it possible to make up the differences in shape between the distal end of the moveable member of the pinch valve actuator and the second shell shaping channel.

There is thus no need for the match in shape to be perfect between the distal end of said moveable member and said second shell shaping channel.

To be precise, in the circuit according to the invention, it is not just two films of the pipe which are sandwiched, but rather the two said films of the pipe as well as the elastically compressible pad.

Thus, the two films of the pipe are applied sealingly against each other, and no biological liquid can flow in the pinched portion of pipe.

Preferably, said pipe to pinch has an elliptical contour.

Compared with a circular pipe, this elliptical contour gives a height saving for the pipe, for an identical speed of passage of the liquid in said elliptical pipe.

According to preferred features of the circuit according to the invention that are simple, convenient and economical:

- said pad forms part of a common sheet covering several pipes;
- said common sheet comprises at least one stiffening projection close to the pad;
- said pad forms part of an individual local plate;
- said pad forms a central portion of said local individual plate, which comprises lateral and transverse walls which surround said central portion;
- said first shell comprises a recessed accommodation adapted to receive said pad at least partially;
- said pad is fastened to said first shell;
- said pad comprises fastening lugs which fasten by complementarity of shape in corresponding apertures of said first shell;
- said pad is formed from elastically compressible flexible plastic molded in one piece;
- said pad is made of silicone;
- the moveable member of the actuator comprises a pneumatic membrane adapted to push said pad towards the second shell shaping channel;
- the moveable member of the actuator comprises a finger having an end shaped like the second shell shaping channel;
- at least one said shell comprises at least one sensor of a physico-chemical value; and
- said sensor and said pad are disposed on said first shell.

The disclosure of the invention will now be continued with the description of an example embodiment, given below by way of illustrative but non-limiting example, with reference to the accompanying drawings, in which.

Figure 1:
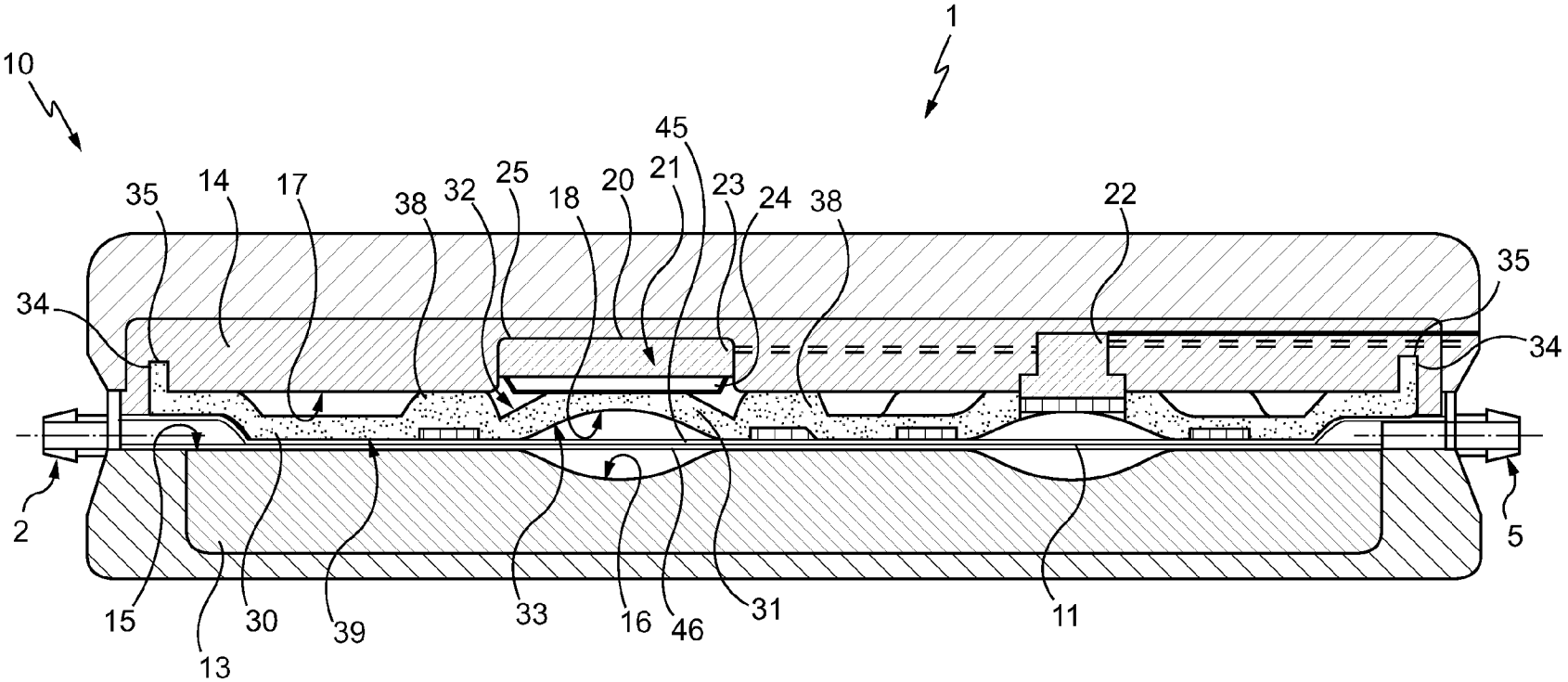
FIGS. 1 to 3 are cross-section views of a circuit for biological liquid according to a first embodiment of the invention, respectively with an open valve and pipes not yet formed, with an open valve and formed pipes, and with a closed valve.
Figure 2:
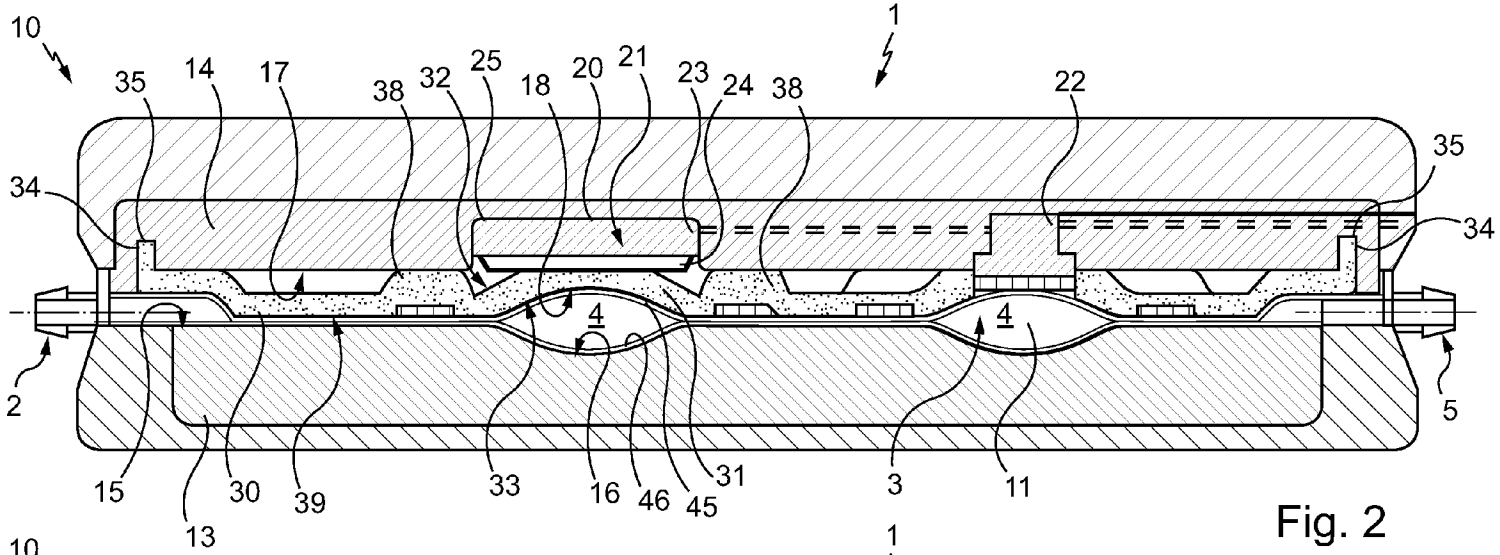
Figure 3:
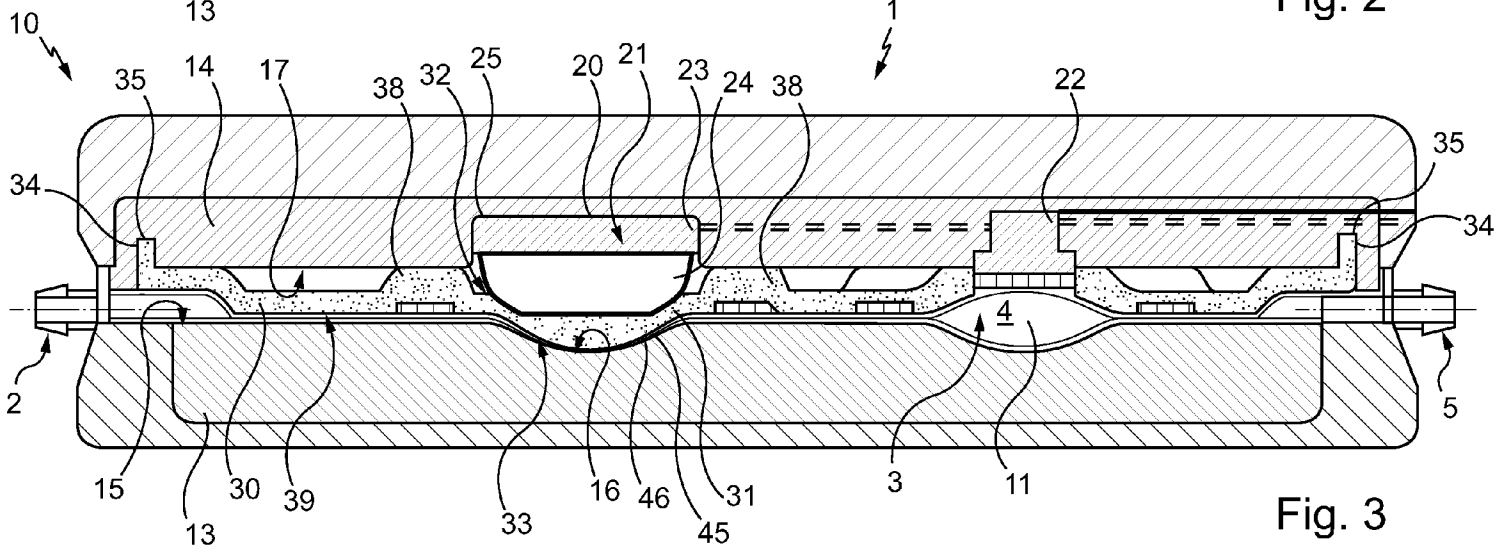

FIGS. 1 to 3 illustrate a press 10 and a bag 11 which make it possible to obtain a circuit 1 for treatment of a biological liquid comprising a plurality of connectors for liquid 2 and a network 3 for liquid routing between those connectors 2, of which pipes 4 are visible.

The press 10 comprises two shells 13 and 14.

The shells 13 and 14 are each formed from a sold block of stiff material. Here, the shells 13 and 14 are of stainless steel and are each of generally parallelepiped shape.

Shell 13 has a reference surface 15, which is flat here, and a plurality of shaping channels 16 recessed into surface 15.

Shell 14 has a flat surface 17 on which is fastened a sheet 30 having a surface 39, and shaping channels 18 that are recessed relative to surface 39 of sheet 30, each facing a corresponding shaping channel 16.

Generally, the surfaces 15, 17 and 33 have similar dimensions and the arrangement of the shaping channels 18 is the mirror image of the arrangement of the shaping channels 16.

The shaping channels 16 and 18 are of semi-elliptical cross-section.

The surfaces 15 and 39 may be applied against each other with the channels 16 and 18 in register with each other to delimit a network of cavities which are each generally tubular.

Shell 14 comprises two apertures 35, and sheet 30 comprises two fastening lugs 34 which fasten by complementarity of shape in the corresponding apertures 35 of shell 14.

In addition to the shells 13 and 14, the press 10 comprises, here implanted on shell 14, pinch valves 20 comprising actuators 21 to pinch a pipe 4, and sensors 22 of a physico-chemical value, for example pressure or temperature.

The actuators 21 each comprise a body 23 fastened to the shell 14 and a moveable pinching membrane 24 having a retracted position when the valve 20 is in an open position (see FIGS. 1 and 2), and an extended position when the valve 20 is in a closed position (see FIG. 3).

The body 23 is housed in a recess 25 of shell 14.

In the extended position, the moveable membrane 24 projects into one of the channels 18.

The valve 20 further comprises, in register with the moveable membrane 24, an elastically compressible pad 31, which pad 31 forms part of the silicone sheet 30 molded in one piece which covers the majority of the surface 17 of the shell 14 so as to cover several pipes 4.

This pad 31 has a first face 32 nearest the moveable membrane 24 and a second face 33 nearest the pipe to pinch 4.

The second face 33 of the pad is concave and locally delimits the shaping channel 18 of the shell 14.

The common sheet 30 has two stiffening projections 38 close to the pad 31.

Each sensor 22 is fastened to the shell 14 in register with a channel 18, with the distal end of the sensor 22 emerging into that channel 18, without actually having to touch the fluid.

Such sensors are well known and comprise for example pressure sensors which measure the pressure via the outer surface of the bag.

At each sensor 22, to enable the putting in place thereof, the shaping channel 18 is not exactly the mirror image of the channel 16.

The bag 11 comprises two flexible films 45 and 46 attached to each other by a seal delimiting a closed contour.

Here, each of the films 45 and 46 is a PureFlex™ film from the applicant. This is a co-extruded film comprising four layers, respectively, from the inside to the outside, a layer of ultra low density polyethylene (ULDPE) forming the material for contact with the liquid, a copolymer of ethylene and vinyl alcohol (EVOH) forming a barrier to gases, a copolymer layer of ethylene and vinyl acetate (EVA) and a layer of ultra low density polyethylene (ULDPE) forming the outer layers.

The seal is a weld bead formed at the periphery of the films 45 and 46.

In addition to the films 45 and 46 and the connectors 2 for liquid, the bag 11 comprises a connector for a pneumatic agent 5 to form the pipes 4.

The dimensions of the bag 11 correspond to those of the surfaces 15 and 17 of the shells 13 and 14 and the surface 39 of the sheet 30.

The bag 11 is intended to be clamped by the shells 13 and 14 with one of the faces of the bag 11 in contact with a face of the shell 13 (this face having the surface 15 and the channels 16), and with the other face of the bag 11 being in contact with a face of the shell 30 (this face presenting surface 39).

FIG. 1 shows the bag 11 in place between the shells 13 and 14, with the surfaces 15 and 39 in contact with the bag 11, but without the shells 13 and 14 being clamped against each other (pre-closure position).

The bag 11 is then inflated: the connectors 2 for liquid are obturated and a pneumatic agent is injected by the connector 5 provided for that purpose.

The effect of the inflation of the bag 11 is that the films 45 and 46 respectively conform to the face of the shell 13 which presents the surface 15 and the channels 16, and the face of the sheet 30 which presents the surface 39 and the channels 18.

The press 10 is then closed, that is to say that the shells 13 and 14 are strongly pressed against each other while sandwiching the bag 11 (closed position in which the bag 11 is clamped between the shells 13 and 14).

The films 45 and 46 are then pressed against the face of the shell 13 which presents the surface 15 and the channels 16 and the face of the sheet 30 which presents the surface 39 and the channels 18, adjacent the channels 16 and 18 where they form the pipes 4 of elliptical contour, as shown in FIG. 2.

The press 10 and the bag 11 then form a circuit 1 for treating a biological liquid which is ready to be placed in service.

To simplify the drawings, the shells 13 and 14 have been illustrated in FIGS. 1 and 2 but, as indicated above, in the pre-closure position illustrated in FIG. 1, the shells 13 and 14 are not clamped against each other.

When the biological liquid to treat in the circuit formed by the press 10 and the bag 11 has to be protected from contamination, the bag 11 is provided with obturating plugs in place on each of the connectors for liquid and on the connector for a pneumatic agent and it is sterilized, for example by gamma irradiation. The pneumatic agent injected inside the bag 11 is purified.

For example, the pneumatic agent is compressed air purified by a hydrophobic filter, such as an AERVENT® available from the company Millipore, connected to the inflating connector 5.

The sensors 22 have their distal end (the sensitive end) in contact with a pipe 4. Each sensor 22 makes it possible to know a physico-chemical characteristic of the liquid flowing in the pipe 4 with which its distal end is in contact, for example its temperature or its pressure.

Each actuator 21 enables a pipe 4 to be pinched between its moveable membrane 24 and the shell 13, to allow or prevent the passage of the liquid at that location.

To pinch the pipe 4, the valve 20 passes from its open position (visible in FIG. 2) in which the moveable membrane 24 is in a retracted position in which it does not pinch the pipe 4, to its closed position (visible in FIG. 3) in which the movable membrane 24 is in a position extended by pneumatic inflation of said membrane 24 in which it pinches the pipe 4.

The membrane 24, at the time it is extended, pushes the pad 31 towards the shaping channel 16 of the shell 13.

Thus, the pad 31 passes from its resting configuration in which its second face 33 is concave and locally delimits the shaping channel 18 of the shell 14 of the pipe 4 to pinch, to a pinching configuration in which its second face 33 is convex, with the films 45 and 46 of the bag 11 at the locality of the pipe 4 and the pad 31 being sandwiched between the shaping channel 16 of the shell 13 of the pipe to pinch 4 and the moveable pneumatic pinching membrane 24.

By virtue of its compressibility, the pad 31, enables possible differences in shape between the inflated membrane 24 and the shaping channel 16 of the shell 13 to be made up.

By virtue of the elastically compressible pad 31, the two films 45 and 46 of the pipe 4 are thus applied sealingly against each other and the liquid can no longer flow in the pipe 4.

With the aid of FIGS. 4 to 13 a second embodiment of the pinch valve will now be described.

In the same way as in the press 10, the press 110 comprises two parallelepiped shells 113 and 114 each formed in a solid block of rigid material.

The shells 113 and 114 have a similar arrangement to that of the shells 13 and 14 of FIGS. 1 to 3 in order to delimit a network 103 of cavities, each generally tubular so as then to form pipes 104 of a circuit 100.

For this, shell 113 has a reference surface 115, which is flat here, and a plurality of shaping channels 116 recessed into surface 115.

The shell 114 has a reference surface 117 and shaping channels 118 recessed relative to surface 117, each facing a corresponding shaping channel 116.

Generally, the surfaces 115 and 117 have similar dimensions and the arrangement of the shaping channels 118 is the mirror image of the arrangement of the shaping channels 116.

Channels 116 and 118 are of semi-elliptical cross-section.

In addition to the shells 113 and 114, the press 110 comprises pinch valves 120 on the shell 114, which comprise actuators 121 for pinching a pipe 104.

The actuators 121 each comprise a body 123 fastened to the shell 114 and a moveable pinching finger 124 having a retracted position when the valve 120 is in an open position, and an extended position when the valve 120 is in a closed position.

The body 123 comprises a pneumatic chamber 126, a piston 127 and an accommodation 128 provided with a spring 129 accommodated in the shell, with the spring 129 surrounding a rod linking the piston 127 and the finger 124.

Figure 4:
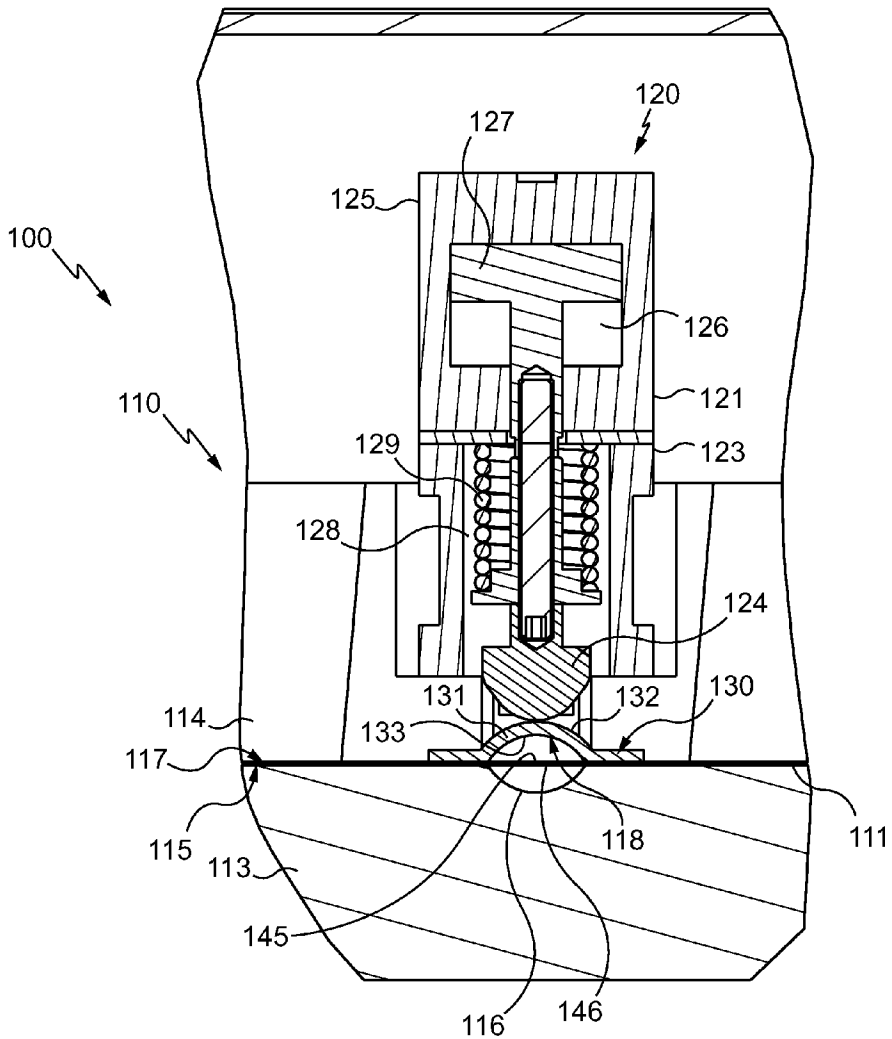
FIGS. 4 to 6 are cross-section views, similar to those of FIGS. 1 to 3, of the circuit according to a second embodiment of the invention.
Figure 5:
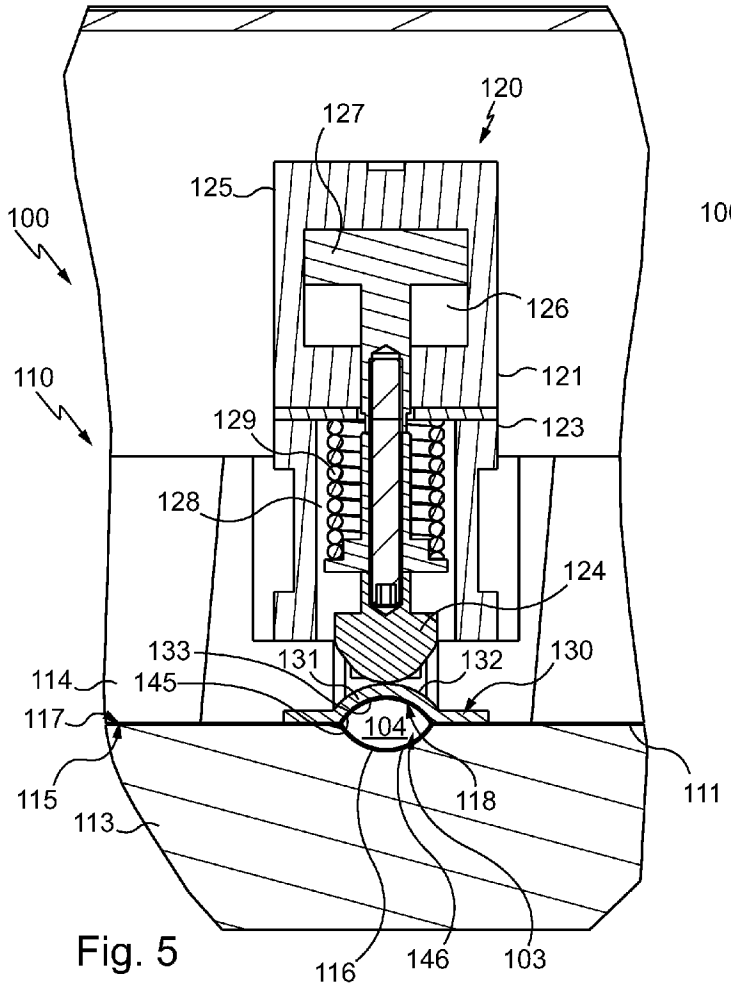

The pneumatic chamber 126, when it is under pressure, biases the piston 127 against the spring 129. When the piston 127 is at the end of its stroke, the finger 124 is in retracted position (FIGS. 4 and 5).

Figure 6:
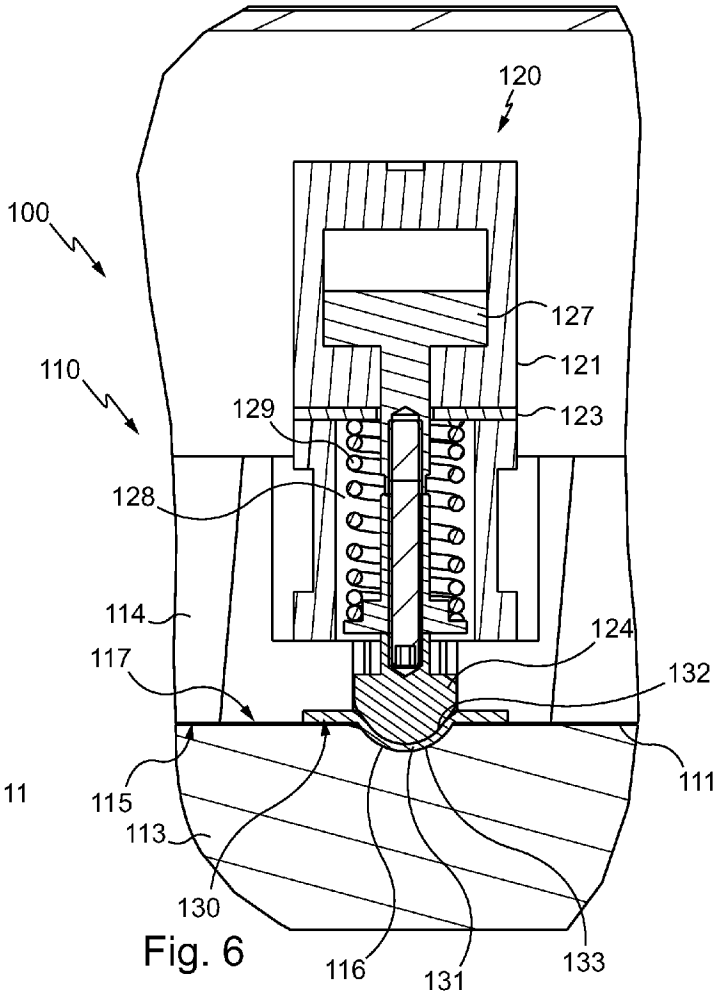

When the pneumatic chamber 126 is at atmospheric pressure, the spring 129 biases the piston 127 towards the other position of end of stroke. When the latter is reached, the moveable finger 124 is in extended position (FIG. 6).

At its distal end, the moveable finger 124 is shaped like the profile of the shaping channel 116 of the shell 113.

In the extended position, the moveable finger 124 projects into one of the channels 118.

The valve 120 further comprises, in register with the moveable finger 124, an elastically compressible pad 131, which pad 131 forms part of an individual local plate 130 (shown in isolation in FIGS. 10 to 13) of silicone molded in one piece.

This pad 131 has a first face 132 nearest the moveable finger 124 and a second face 133 nearest the pipe to pinch 104.

The second face 133 of the pad 131 is concave and locally delimits the shaping channel 118 of the shell 114.

Figure 7:
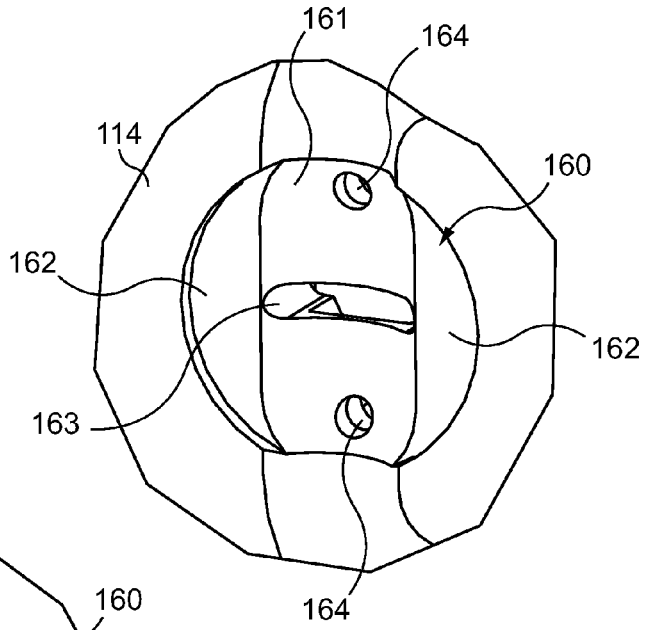
FIGS. 7 and 8 are views in perspective and in elevation of a portion of one of the shells of the circuit of FIGS. 4 to 6 having an accommodation for an elastically compressible pad.
Figure 8:
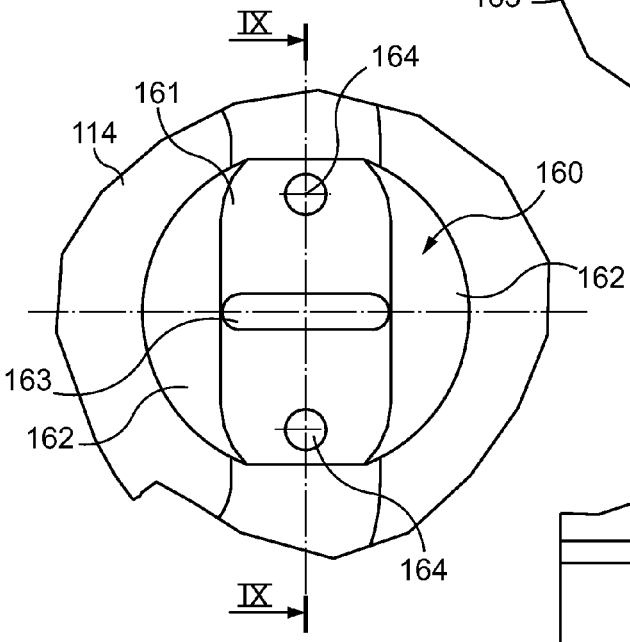
Figure 9:
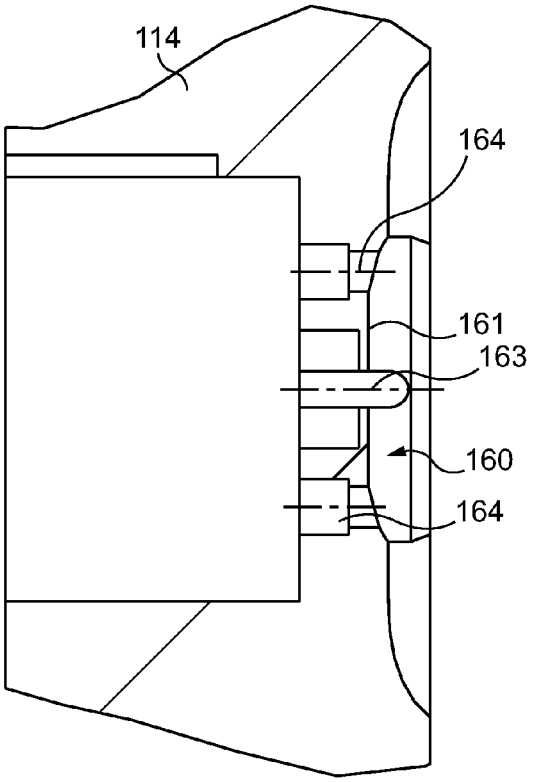
FIG. 9 is the cross-section view on IX-IX of FIG. 8.
Figure 10:
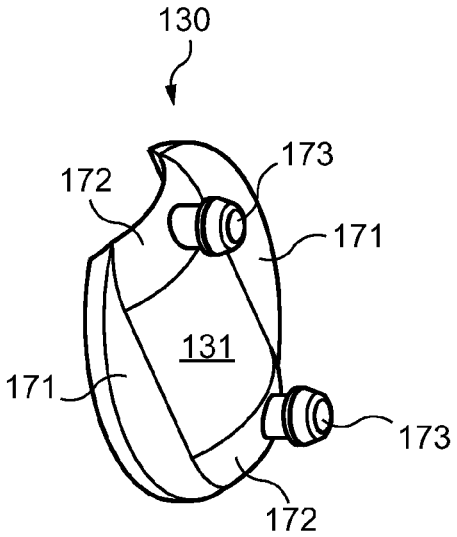
FIGS. 10 to 13 are views respectively, in perspective, of a first side, in elevation, and in perspective of another side turned through 90° relative to the first side, of said elastically compressible pad.
Figure 11:
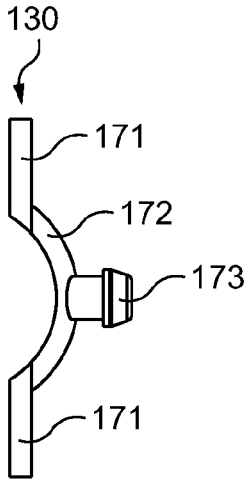
Figure 12:
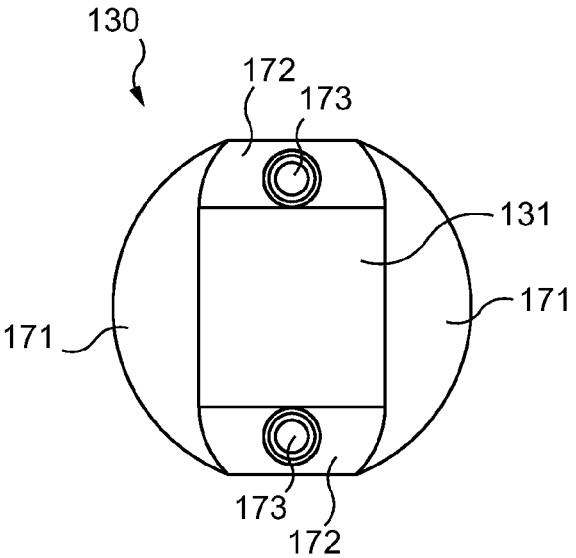
Figure 13:
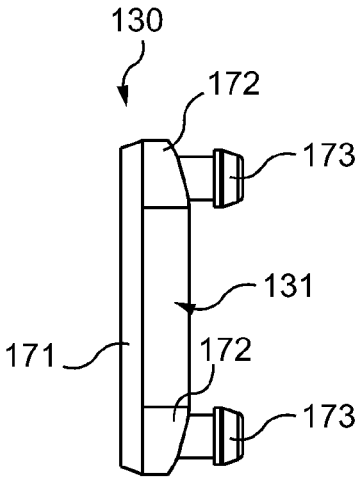

As can be better seen in FIGS. 7 to 9, the shell 114 comprises a recessed accommodation 160 having a curved central portion 161 and two flat lateral portions 162.

The curved central portion 161 has a cut-out 163 in the center that is adapted to allow the moveable pinching finger 124 to pass, and two identical apertures 164 situated at the edge of the central portion 161.

As better seen in FIGS. 10 to 13, the pad 131 forms an arcuate central portion of the plate 130, which comprises flat lateral walls 171 and arcuate transverse walls 172 which surround said central portion.

Each flat lateral wall 171 of the plate 130 is positioned on a flat lateral portion 162 of the accommodation 160 in the shell 114, and each arcuate transverse wall 172 is positioned on the curved central portion 161 of the accommodation 160 in the shell 114.

Thus, the pad 131 is also positioned on the curved central portion 161 of the accommodation 160 in the shell 114.

For it to be fastened on the shell 114, the plate 130 comprises a fastening lug 173 extending from each arcuate transverse wall 172 towards the face of the shell 114 which presents the surface 117 and the channels 118.

These lugs 173 are fastened by complementarity of shape in the corresponding apertures 164 of the shell 114.

The bag 111 comprises two flexible films 145 and 146 attached to each other by a seal delimiting a closed contour.

The bag 111 and the films 145 and 146 are of the same type as the bag 11 and the films 45 and 46 of FIGS. 1 to 3.

Furthermore the pipes 104 are formed in the same way as the pipes 4 of FIGS. 1 to 3.

The dimensions of the bag 111 correspond to those of the reference surfaces 115 and 117 of the shells 113 and 114.

FIG. 4 shows the bag 11 in place between the shells 113 and 114, with the surface 117 in contact with the bag 111, but without the shells 113 and 114 being clamped against each other.

The bag 111 is then inflated and the effect of the inflation is that the films 145 and 146 respectively conform to the face of the shell 113 which presents the surface 115 and the channels 116, and the second face 133 of the pad 131.

The press 110 is then closes such that the shells 113 and 114 are strongly clamped against each other while sandwiching the bag 111.

The films 145 and 146 are then pressed against the face of the shell 113 which presents the surface 115 and the channels 116, and the second face 133 of the pad 131, adjacent the channels 116 and 118 where they form the pipes 104 of elliptical contour, as shown in FIG. 5.

The press 110 and the bag 111 then form a circuit 100 for treating a biological liquid which is ready to be placed in service.

To simplify the drawings, the shells 113 and 114 have been illustrated in the same position in FIGS. 4 and 5 but, as indicated above, in the pre-closure position illustrated in FIG. 4, the shells 113 and 114 are not clamped against each other.

Each actuator 121 enables a pipe 104 to be pinched between its moveable finger 124 and shell 113, to allow or prevent the passage of the liquid at that location.

To pinch the pipe 104, the valve 120 passes from its open position (FIG. 5) in which the moveable finger 124 is in a retracted position in which it does not pinch the pipe 104, to its closed position (FIG. 6) in which the moveable finger 124 is in an extended position in which it pinches the pipe 104.

The finger 124, at the time it is extended, pushes the pad 131 towards the shaping channel 116 of the shell 113.

Thus, the pad 131 passes from a resting configuration in which its second face 133 is concave and locally delimits the shaping channel 118 of the shell 114 of the pipe 104 to pinch, to a pinching configuration in which its second face 133 is convex, with the pipe 104 and the pad 131 sandwiched between the shaping channel 116 of the shell 113 of the pipe to pinch 104 and the moveable pinching finger 124.

In a variant not illustrated, the pipe to pinch has a circular contour.

In the example illustrated in FIGS. 4 to 13, the moveable pinching member 124 of the actuator 121 has a thick edge at its end. As a variant, the moveable member of the actuator has thin edge, for example by virtue of a beveled end.

In variants not illustrated, the inflation of the bag is carried out after the clamping of the bag, or partially before and partially after the clamping of the bag.

In a variant not illustrated, the pipes of the network for routing fluid are pre-formed, and the welding of the films is carried out before the bag is clamped between said shells.

In a variant not illustrated, rather than being dispersed over the same shells, the sensor or sensors of a physico-chemical value and the pad are disposed on different shells; and/or no sensor is provided.

In other variants not represented:

instead of being in one piece, the shells are formed by a set of modular members associated with each other to delimit the different portions of the circuit, which members are provided with marks or labels to ensure that they are correctly disposed relative to each other, the marks and the labels comprising for example reference numbers or codes, and possibly being of the RFID type.

the shells are of a material other than stainless steel, for example aluminum, plastic having in particular a high density, ceramic or wood;

the films of the bag are of a material other than the PureFlex™ film, for example of another film with several layers compatible with biological liquids such as the film HyQ® CX5-14 available from the company Hyclone industries, or the film Platinum UltraPac available from the company Lonza;

the single-acting pneumatic jack serving to actuate the finger such as 124 is replaced by a double-acting pneumatic jack and/or the jack is of a nature other than pneumatic, for example electrical;

the pad is not a one-piece molding.

It should be noted more generally that the invention is not limited to the examples described and represented.

The invention claimed is:

1. A circuit for biological liquid, comprising a plurality of routing connectors (2) and a network (3; 103) for routing liquid between said connectors, comprising:

a bag (11; 111) comprising two flexible films (45, 46; 145, 146) and said routing network connectors (2); and a press (10; 110) comprising a first shell (14; 114) and a second shell (13; 113) clamping said bag (11; 111) in a state in which pipes (4; 104) of said liquid routing network (3; 103) are formed between said films (45, 46; 145, 146), said first shell (14; 114) comprising for each of said pipes (4; 104) a shaping channel (18; 118), said second shell (13; 113) comprising for each of said pipes (4; 104) a shaping channel (16; 116) facing a corresponding shaping channel (18; 118) of the first shell (14; 114); with said first shell (14; 114) comprising at least one pinch valve (20; 120) for one of said pipes (4; 104), wherein the valve (20; 120) comprises an actuator (21; 121) comprising a movable pinching member (24; 124), wherein the valve (20; 120) has an open position in which the moveable member (24; 124) is in a retracted position in which it does not pinch the pipe (4; 104) and has a closed position in which the moveable member (24; 124) is in an extended position in which it pinches the pipe (4; 104);

said valve (20; 120) further comprising, in register with said moveable pinching member (24; 124), an elastically compressible pad (31; 131), wherein the pad (31; 131) has a first face (32; 132) nearest the moveable member (24; 124) and a second face (33; 133) nearest the pipe corresponding to said pinching member (4; 104), wherein the pad (31; 131), when the valve (20; 120) is in an open position, has a resting configuration in which said second face (33; 133) is concave and locally delimits the first shell shaping channel (18; 118) of the pipe corresponding to said pinching member (4; 104), and, when the valve (20; 120) is in a closed position, has a pinching configuration in which said second face (33; 133) is convex, with said pipe (4; 104) and said pad (31; 131) sandwiched between the second shell shaping channel (16; 116) of the pipe corresponding to said pinching member (4; 104) and the moveable pinching member (24; 124); wherein said pad (131) forms part of an individual local plate (130).

2. A circuit according to claim 1, wherein said pad (131) forms a central portion of said individual local plate (130), which comprises lateral (171) and transverse (172) walls which surround said central portion.

3. A circuit according to claim 1, wherein said pipe corresponding to said pinching member (4; 104) has an elliptical contour.

4. A circuit according to claim 1, wherein said first shell (114) comprises a recessed accommodation (160) adapted to receive said pad (131) at least partially.

5. A circuit according to claim 1, wherein said pad (31; 131) is fastened to said first shell (14; 114).

6. A circuit according to claim 5, wherein said pad (31; 131) comprises fastening lugs (34, 35; 173) which fasten by complementarity of shape in corresponding apertures (36, 37; 164) of said first shell (14, 114).

7. A circuit according to claim 1, wherein said pad (31; 131) is formed from elastically compressible flexible plastic molded in one piece.

8. A circuit according to claim 1, wherein said pad (31; 131) is made of silicone.

9. A circuit according to claim 1, wherein the moveable member of the actuator (21) comprises a pneumatic membrane (24) adapted to push said pad (31) towards the second shell shaping channel (16).

10. A circuit according to claim 1, wherein the moveable member of the actuator (121) comprises a finger (124) having an end shaped like the second shell shaping channel (116).

11. A circuit according to claim 1, wherein at least one of said first and second shells comprises at least one sensor (22) of a physico-chemical quantity.

12. A circuit according to claim 11, wherein said sensor (22) and said pad (31) are disposed on said first shell (14).

* * * * *